US006240809B1

(12) United States Patent
Sasarak

(10) Patent No.: US 6,240,809 B1
(45) Date of Patent: Jun. 5, 2001

(54) MODIFIED RATCHET DEVICES

(76) Inventor: Joseph Sasarak, 94 Middlehill Rd., Colonia, NJ (US) 07067

( * ) Notice: Subject to any disclaimer, the term of this patent is extended or adjusted under 35 U.S.C. 154(b) by 0 days.

(21) Appl. No.: 09/348,945

(22) Filed: Jul. 7, 1999

(51) Int. Cl.[7] ..... B25B 13/00
(52) U.S. Cl. ..... 81/60; 81/58; 81/58.4; 81/63.1
(58) Field of Search ..... 81/60, 58, 58.4, 81/63.1, 177.2

(56) References Cited

U.S. PATENT DOCUMENTS

| | | | | |
|---|---|---|---|---|
| D. 225,606 | | 12/1972 | Teichmeier | D8/25 |
| D. 260,353 | | 8/1981 | Redman | D8/25 |
| 4,344,340 | | 8/1982 | Erickson | 81/177 |
| 4,984,844 | * | 1/1991 | Tekeyan . | |
| 5,797,300 | * | 8/1998 | Fairbanks . | |
| 5,921,157 | * | 7/1999 | Smith et al. . | |
| 5,979,273 | * | 11/1999 | Walton . | |

OTHER PUBLICATIONS

JC Whitney, "Everything Automotive" Jul. 1999, pp. 191, 205, LaSalle, II.

* cited by examiner

*Primary Examiner*—Timothy V. Eley
*Assistant Examiner*—Willie Berry, Jr.
(74) *Attorney, Agent, or Firm*—Walter J. Tencza, Jr.

(57) ABSTRACT

An apparatus comprising a first handle, a second handle, and a ratchet device is disclosed. The ratchet device has an attachment end and a base. The attachment device is rotatable with respect to the base either clockwise or counterclockwise but not both. The ratchet device has a left side and a right side, and the first handle is connected to the base of the ratchet device at the left side of the base. The second handle is connected to the base of the ratchet device at the right side of the base. The first and second handles can be an elongated bars having a first end and a seconds end. The first handle can be connected at its first end to the left side of the base of the ratchet device while the second handle is connected at its first end to the right side of the base. The first ends of the first and second handles may have extensions. The base of the ratchet device may have a recess on its left side and on its right side. The first handle can be connected to the left side of the base of the ratchet device by inserting the extension of the first end of the first handle into the recess on the left side of the base of the ratchet device and the second handle can be connected to the right side of the base of the ratchet device by inserting the extension of the first end of the second handle into the recess on the right side of the base of the ratchet device. In some embodiments the first handle and the second handle can be disconnected from the base of the ratchet device. In some embodiments, the second handle can be disconnected from the base of the ratchet device, the first handle has a recess at its second end, and the second handle can be connected to the first handle by inserting the extension of the first end of the second handle into the recess at the second end of the first handle.

14 Claims, 6 Drawing Sheets

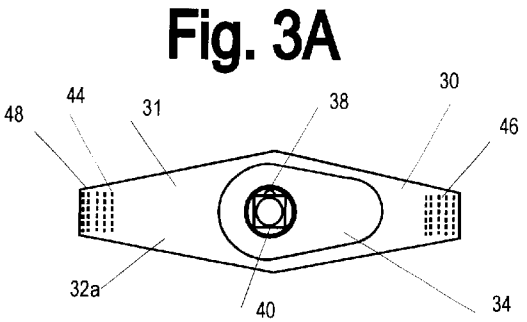
Fig. 3A
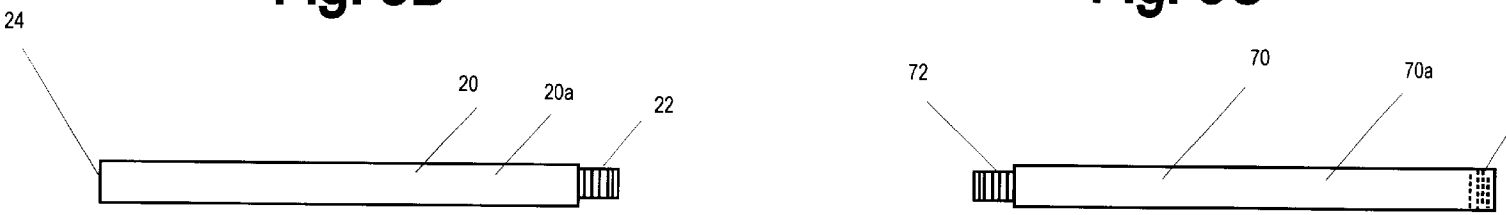
Fig. 3B
Fig. 3C
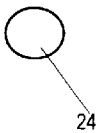
Fig. 3D
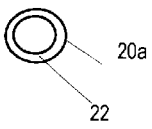
Fig. 3E
Fig. 3F
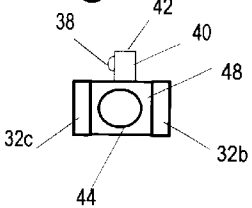
Fig. 3G

MODIFIED RATCHET DEVICES

FIELD OF THE INVENTION

This invention relates to improved methods and apparatus for hand tools such as ratchet wrenches and lug wrenches.

BACKGROUND OF THE INVENTION

Various hand tools are known in the art. Ratchet wrenches and lug wrenches are known. There is a need for better hand tools for specific purposes.

SUMMARY OF THE INVENTION

The present invention in one embodiment provides a apparatus comprising a first handle a second handle, and a ratchet device. The ratchet device has an attachment device and a base. The attachment device is rotatable with respect to the base either clockwise or counterclockwise but not both. The ratchet device has a left side and a right side, and the first handle is connected to the base of the ratchet device at the left side of the base. The second handle is connected to the base of the ratchet device at the right side of the base.

The first and second handles can be an elongated bars each having a first end and a second end. The first handle can be connected at its first end to the left side of the base of the ratchet device while the second handle is connected at its first end to the right side of the base. The first ends of the first and second handles may have extensions. The base of the ratchet device may have a recess on its left side and on its right side. The first handle can be connected to the left side of the base of the ratchet device by inserting the extension of the first end of the first handle into the recess on the left side of the base of the ratchet device and the second handle can be connected to the right side of the base of the ratchet device by inserting the extension of the first end of the second handle into the recess on the right side of the base of the ratchet device.

In some embodiments the first handle and the second handle can be disconnected from the base of the ratchet device.

The extensions of the first and second handle may have threads on them and the recesses on the left side and right side of the base of the ratchet device may have internal threads on its inner surface so that the first handle and the second handle can be screwed into the left side and the right side of the base of the ratchet device, respectively. The extensions of the first and second handle may have springy devices connected to them so that they can be inserted into the recesses of the base of the ratchet device and held to the base.

In some embodiments, the second handle can be disconnected from the base of the ratchet device, the first handle has a recess at its second end, and the second handle can be connected to the first handle by inserting the extension of the first end of the second handle into the recess at the second end of the first handle.

BRIEF DESCRIPTION OF THE DRAWINGS

FIG. 3A shows a top view of the ratchet device of the embodiments of FIGS. 1 and 2, and additionally with dashed lines showing internal threads;

FIGS. 3B and 3C show top views of the handles which are attached to the ratchet device of FIG. 3A to form a modified ratched device such as shown in FIGS. 1 and 2;

FIG. 3D show a back view of the handle of FIG. 3B;

FIG. 3E shows a front view of the handle of FIG. 3B;

FIG. 3F shows a back view of the handle of FIG. 3C;

FIG. 3G shows a front view of the ratchet device of FIG. 3A;

DETAILED DESCRIPTION OF THE DRAWINGS

Figure 1:
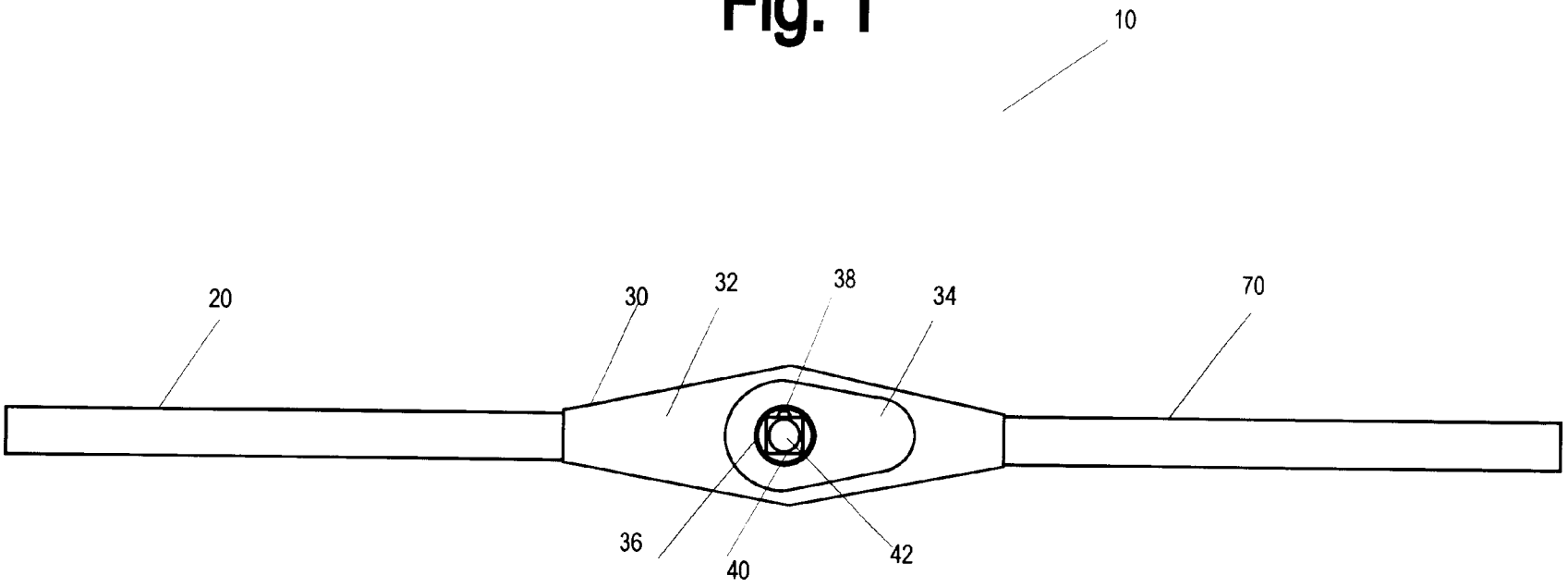
FIG. 1 shows a top view of an apparatus for forming a T-handled lug wrench in accordance with an embodiment of the present invention.

FIG. 1 shows a top view of an apparatus 10 for forming a T-handled lug wrench in accordance with an embodiment of the present invention. The apparatus 10 is comprised of handle 20, ratchet device 30, and handle 70. One can also think of the handle 20, ratchet device 30, and handle 70 as being part of a single ratchet device, after the handles 20 and 70 are attached to ratchet device 30. The handles 20 and 70 can be solid steel round bars.

Figure 4A:
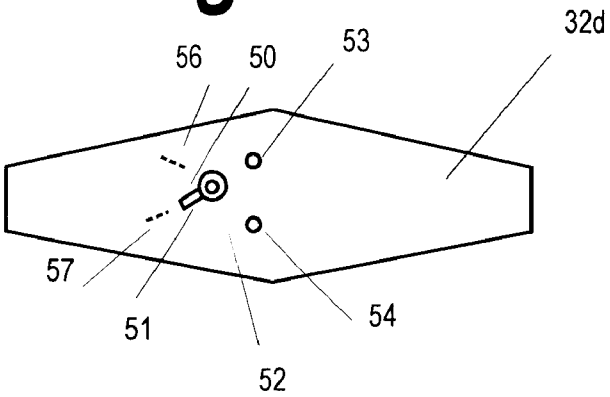
FIG. 4A shows a bottom view of the ratched device of FIG. 3A.
Figure 4B:
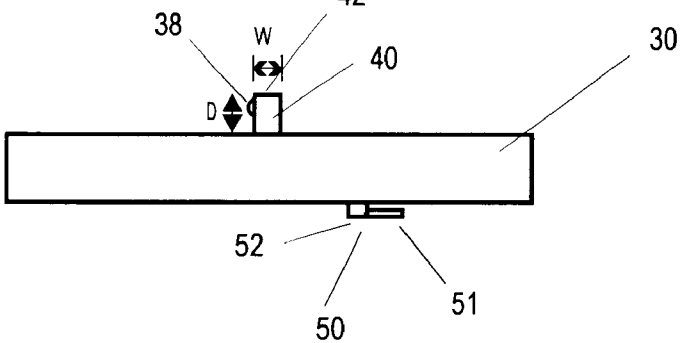
FIG. 4B shows a side view of the ratchet device of FIG. 3A.

Ratchet device 30 is comprised of base portion 32, base portion 34, circular rotatable portion 36, springy semi-circular element 38, cubic attachment device 40, and top surface circular portion 42. The form of the components 34, 36, 38, 40, and 42 is known in the art and was previously described in U.S. Pat. No. 4,934,220, which is incorporated by reference herein. Referring to FIG. 1 and FIG. 4B, the cubic attachment device 40 is fixed to the circular rotatable portion 36. The cubic attachment device 40 and the circular rotatable portion 36 can be rotated (either clockwise or counterclockwise but not both) so that the circular rotatable portion 36 rotates while the base portion 34 remains stationary. A switch 50 shown in FIGS. 4A and 4B determines whether the cubic attachment device 40 and the circular rotatable portion 36 can rotate clockwise or counterclockwise. The switch 50 has an extension 51 and a pivot 52. If the extension 51 is in line with the line 57 as shown in FIG. 4A then the circular rotatable portion 36 can rotate clockwise only. If the extension 51 is rotated about pivot point 52 so that the extension is in line with the line 56 then the circular rotatable portion 36 can rotate counterclockwise only.

Figure 2:
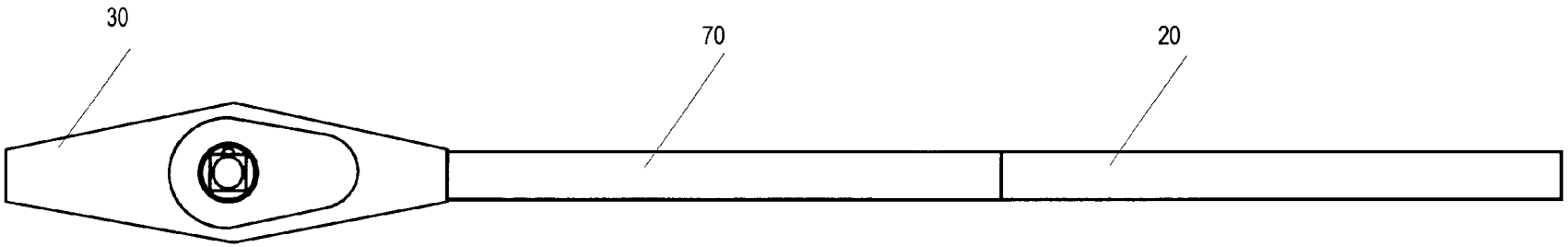
FIG. 2 shows a top view of the components of the apparatus of FIG. 1 in a different configuration.

FIG. 2 shows a top view of another configuration in accordance with the present invention. In this configuration the ratchet device 30 has the handles 70 and 20 connected on one side.

FIG. 3A shows a top view of the ratchet device 30 of the embodiments of FIGS. 1 and 2, and additionally with dashed lines showing internal threads. On its left side the ratchet device 30 has internal threads 44 shown by dashed lines. On its right side the ratchet device 30 has internal threads 46 shown by dashed lines. Where the internal threads 44 are there is a substantially circular recess as shown in FIG. 3G, and this is the same on the right side of ratchet device 30 for internal threads 46. The handle 20 shown in FIG. 3B has an extension 22 which has threads. This extension 22 can be placed inside the recess where the internal threads 44 are and screwed in, to connect the handle 20 to the left side of ratchet device 3A as shown by FIGS. 1 and 3A. Similarly the handle 70 has an extension 72 which has threads and this extension can be screwed into the recess area where internal threads 46 are on the right side of the ratchet device 3A. The handle 70 differs from the handle 20 in that the handle 70 also has internal threads 74 shown by dashed lines in FIG. 3C. The extension 22 of the handle 20 can be screwed into the recess where the internal threads 74 are to form the configuration shown in FIG. 2 (i.e. double handle on one side).

FIG. 3D show a back view of the handle 20 of FIG. 3B including solid back end 24. FIG. 3E shows a front view of the handle 20 of FIG. 3B, including the extension 22 and the outer portion 20*a*. The front view of the handle 70 for extension 72 would be the same. FIG. 3F shows a back view of the handle 70 of FIG. 3C, including the recess where internal threads 74 are located and the outer portion 70*a*. FIG. 3G shows a front view of the ratchet device of FIG. 3A. The FIG. 3G includes right side 32*b* and left side 32*c*. Also shown is outer portion 48 and recess or internal threads area 44. The cubic attachment device 40, springy semicircular portion, and top surface 42 are also shown in FIG. 3G.

FIG. 4A shows a bottom view of the ratched device 30 of FIG. 3A. The bottom surface 32*d* is shown in FIG. 4A. In addition tops of screws 53 and 54 for fixing the base 34 to the base 31 are also shown. The switch 51 has already been described FIG. 4B shows a side view of the ratchet device 30 of FIG. 3A. This includes cubic attachment device 40, springy portion 38, and top surface 42, as well as switch 50.

Figure 5:
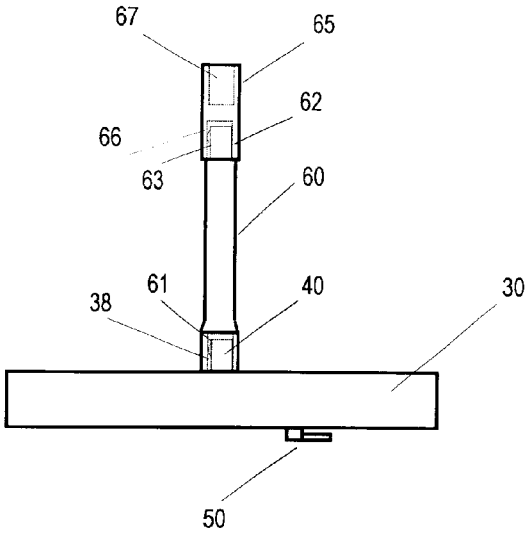
FIG. 5 shows a side view of the ratched device of FIG. 3A connected to a ratchet extension and a socket for taking lug nuts off a car.

FIG. 5 shows a side view of the ratchet device 30 of FIG. 3A connected to a ratchet extension 60 and a socket 65 for taking lug nuts off to allow for example an automobile tire to be removed. The configuration of FIG. 5 can be used along with the handles 20 and 70 in the configuration of FIG. 1 or FIG. 2. The extension 60 has a recess 61, shown in dashed lines, in which the attachment device 40 fits. The springy circular portion 38 is forced inwards into the attachment device 40 by the internal surface of the recess 61. The force of the springy circular portion 38 pressing back on the internal surface of the recess 61 holds the extension 60 on the attachment device 40 of the ratchet device 30. The extension 60 has a square extension 62 with a springy portion 63 similar to the attachment device 40 and springy portion 38. This square extension 62 is used to hold the socket 65 onto the extension 60. The springy portion 63 presses against the inner surface of a recess 66 of the socket 65. The other end of the socket 65 has a recess 67 which is adapted to fit over a lug nut for an automobile, cap screw, or nut.

Figure 7:
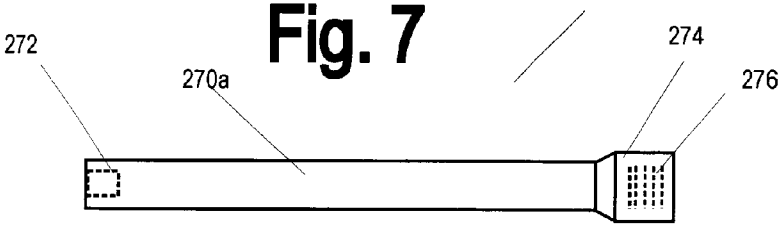
FIG. 7 shows a top view of another handle in accordance with the present invention for connecting with the ratchet device of FIG. 3A, where one end has a socket wrench like extension.
Figure 6:
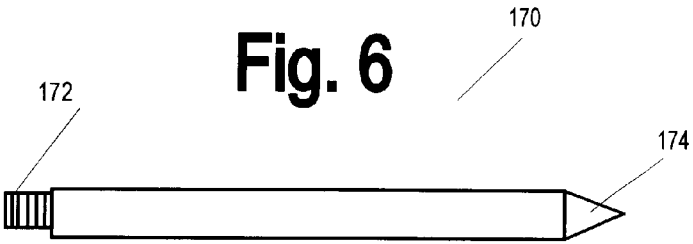
FIG. 6 shows a top view of another handle in accordance with the present invention for connecting with the ratchet device of FIG. 3A, where one end has a screwdriver like extension.

FIG. 6 shows a top view of another handle 170 in accordance with the present invention for connecting with the ratchet device 30 of FIG. 3A, where one end has a screwdriver like extension 174. The handle 170 can be used for removing hub caps and center caps from cars. The other end has an extension 172 as was the case for handle 70. FIG. 7 shows a top view of another handle 270 in accordance with the present invention for connecting with the ratchet device 30 of FIG. 3A, where one end has a socket wrench like extension 274. The handle 270 of FIG. 7 can be used for taking lug nuts off a car. The extension 274 has an internal recess 276. The internal recess 276 may be in the shape of a hexagon for removing a nut. Another internal recess 272 is used for inserting the attachment device 40 into the recess 272, similar to that shown in FIG. 6 where attachment device 40 is inserted into the recess 61 of extension 60.

Figure 8A:
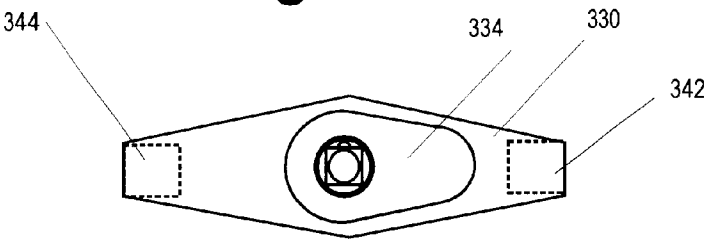
FIG. 8A shows a top view of a ratchet device where the ratchet device has recesses without threads.
Figure 8C:
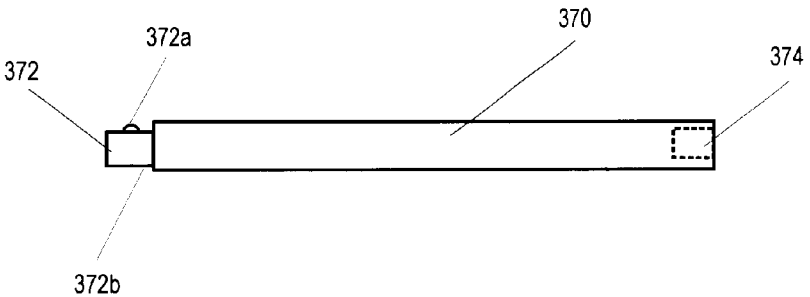
FIGS. 8B and 8C show top views of other handles for functioning with the embodiment of FIG. 8A.
Figure 8B:
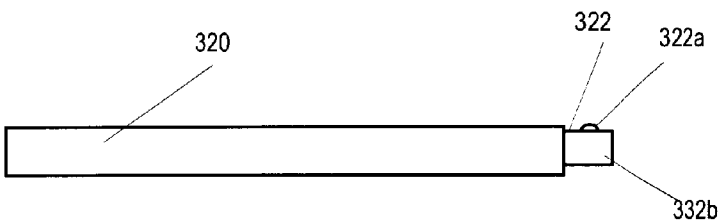

FIG. 8A shows a top view of a ratchet device 30 where the ratchet device 330 has recesses without internal threads. FIG. 8A shows square recesses 344 and 342. FIGS. 8B and 8C show top views of handles 320 and 370 for functioning with the embodiment of FIG. 8A. The handle 320 includes a square extension 322 and a springy element 322*a*. The handle 370 similarly includes a square extension 372 with a spring element 372*a*. The square extension 322 can be placed in the recess 344 of ratchet device 330. The springy device 322*a* would press against the internal surface of recess 344 to hold the handle onto the ratchet device 330. Similarly the springy device 372*a* would press against the internal surface of recess 342 to hold the handle onto the ratchet device 330. The handle 370 also has an internal recess 374. The handles 320 and 370 can be set up in a similar configuration to FIG. 2 (double handle on one side) where the extension 322 of the handle 320 is inserted into the recess 374 of the handle 370.

In operation, an individual would take handle 20 as shown in FIG. 3B and insert the extension 22 into recess and internal thread portion 44 of ratchet device 30 of FIG. 3B by screwing the handle 20 into the portion 44. The user would then take the handle 70 shown in FIG. 3C and insert the extension 72 into recess and internal thread portion 46 of ratchet device 30 of FIG. 3C by screwing the handle 70 into portion 46. This achieves the configuration of FIG. 1. The user can then use the attachment device 40 on the ratchet device 30 as a ratchet wrench for any purpose desired. For example, as shown in FIG. 5 the ratchet device 30 may be inserted into an extension device 60 on which is placed a socket 65, for removing lug nuts which hold an automobile wheel. The handles 20 and 70 should be added to the configuration of FIG. 5. Note that the substantially cubic attachment device 40 can rotate in one direction, such as clockwise, but not in the other direction, such as counter-clockwise. This allows one to exert force on a nut to remove it (no rotation of the attachment device 40 with respect to the base 34) and then to rotate the attachment device 40 to get the ratchet device 30 and handles 20 and 70 to a new position (rotation of the extension 40 with respect to the base 34).

Alternatively, the handles may be screwed in to achieve the configuration of FIG. 2, with the extension 22 of the handle 20 screwed into the recess 74 of the handle 70. In another configuration shown by FIGS. 8A–C, the extension 322 may be inserted into the recess 344 to connect handle 320 to ratchet device 330. The extension 372 may be inserted into the recess 342 to connect handle 370 to ratchet device 330. This would form a configuration similar to FIG. 1. A configuration similar to FIG. 2 can be formed by inserting the handle 370 into ratchet device 330 as just described and inserting the extension 322 of the handle 320 into the recess 374 of handle 370.

The handle 170 of FIG. 6 can be used as a screwdriver for removing hubcaps and centercaps of automobiles by inserting the extension 172 into the ratchet device 30 and by using the screwdriver end 174 as a screw driver. The handle 270 can be used as a socket wrench by inserting the attachment device 40 of the ratchet device 30 into the recess 272 of the handle 270 and using the end 276 as a socket wrench, for removing automobile nuts.

The present invention is advantageous in that the device of the configuration of FIG. 1 or FIG. 2 or other embodiments can be taken apart allowing it to be easily stored. The configuration of FIG. 2 gives additional torque when it is necessary. The configuration of FIG. 1 makes it easier for certain purposes to unscrew a nut such as a lug nut from an automobile.

In present invention in some embodiments removes hard to break cap screws, nuts, and lugnuts. In the T-handle embodiment or configuration of FIG. 1 both hands can be used to double the turning strength. The present invention makes removing lugnuts, for example, simple and safe for everyone including the elderly.

The configuration of FIG. 1 may have a length from the far end of handle 20 to the far end of handle 70 of about twenty-five and ¾ inches. The attachment device 40 may have a ½ inch length, width, and depth. The handles 20 and 70 and the majority of the ratchet device 30 may be made of tool grade forged steel. The actual ratcheting mechanism (including attachment device 40, circular portion 38) of the ratchet device 30 may be a heavy duty ratchet mechanism.

Knurled handles can be provided for a safe grip on the handles 20 and 70. A proper sized deep socket could be permanently attached to an extension to be sold as an accessory and kept in trunk of the car. Handle 270 would be an example of a deep sized socket (276) permanently attached to the extension part 270*a*. The handles 20 and 70 may have lengths of 9 and ⅞ inches. The ratchet device 30 as shown in FIG. 1 may have a length of 6 inches. The total length may be 25 and ¾ inches. The solid steel handles 20 and 70 may have a diameter of ¾ of an inch and the attachment device 40 may be made in various sizes such as ¼ inches in width W shown in FIG. 4B (length can be the same) to 1 inch in width W (length can be the same). The depth, D, shown in FIG. 4B can be the same as the length and width of the square surface of the cubic attachment device 40.

The present invention in some embodiments can be used in industrial or commercial applications. It can be made in smaller or larger sizes. It can be made with smaller or larger T-handle ratchets with different size handles and different size base.

I claim:

1. An apparatus comprising:

a first handle;

a second handle;

a ratchet device having an attachment device and a base;

wherein the attachment device is rotatable with respect to the base either clockwise or counterclockwise but not both, wherein the base of the ratchet device has a left side and a right side, and the first handle is connected to the base of the ratchet device at the left side of the base; and the second handle is connected to the base of the ratchet device at the right side of the base;

wherein the first handle is an elongated bar having a first end and a second end and the first handle is connected to the left side of the base of the ratchet device at the first end of the first handle; and the second handle is an elongated bar having a first end and a second end and the second handle is connected to the right side of the base of the ratchet device at the first end of the second handle;

wherein the first end of the first handle has an extension;

the first end of the second handle has an extension;

the base of the ratchet device has a recess on its left side and a recess on its right side;

the first handle is connected to the left side of the base of the ratchet device by inserting the extension of the first end of the first handle into the recess on the left side of the base of the ratchet device; and the second handle is connected to the right side of the base of the ratchet device by inserting the extension of the first end of the second handle into the recess on the right side of the base of the ratchet device; and wherein the first handle and the second handle can be disconnected from the base of the ratchet device by unscrewing the first handle from the ratchet device and by unscrewing the second handle from the ratchet device, respectively.

2. An apparatus comprising:

a first handle;

a second handle;

a ratchet device having an attachment device and a base; wherein the attachment device is rotatable with respect to the base either clockwise or counterclockwise but not both, wherein the base of the ratchet device has a left side and a right side, and the first handle is connected to the base of the ratchet device at the left side of the base; and the second handle is connected to the base of the ratchet device at the right side of the base;

wherein the first handle is an elongated bar having a first end and a second end and the first handle is connected to the left side of the base of the ratchet device at the first end of the first handle; and the second handle is an elongated bar having a first end and a second end and the second handle is connected to the right side of the base of the ratchet device at the first end of the second handle;

wherein the first end of the first handle has an extension;

the first end of the second handle has an extension;

the base of the ratchet device has a recess on its left side and a recess on its right side;

the first handle is connected to the left side of the base of the ratchet device by inserting the extension of the first end of the first handle into the recess on the left side of the base of the ratchet device;

the second handle is connected to the right side of the base of the ratchet device by inserting the extension of the first end of the second handle into the recess on the right side of the base of the ratchet device; and wherein the extension of the first handle has threads on it and the recess on the left side of the base of the ratchet device has internal threads on its inner surface so that the first handle can be screwed into the left side of the base of the ratchet device.

3. The apparatus of claim 2 wherein the extension of the second handle has threads on it and the recess on the right side of the base of the ratchet device has internal threads on its inner surface so that the first handle can be screwed into the left side of the base of the ratchet device.

4. An apparatus comprising:

a first handle;

a second handle;

a ratchet device having an attachment device and a base; wherein the attachment device is rotatable with respect to the base either clockwise or counterclockwise but not both, wherein the base of the ratchet device has a left side and a right side, and the first handle is connected to the base of the ratchet device at the left side of the base; and the second handle is connected to the base of the ratchet device at the right side of the base;

wherein the first handle is an elongated bar having a first end and a second end and the first handle is connected to the left side of the base of the ratchet device at the first end of the first handle; and the second handle is an elongated bar having a first end and a second end and the second handle is connected to the right side of the base of the ratchet device at the first end of the second handle;

wherein the first end of the first handle has an extension;

the first end of the second handle has an extension;

the base of the ratchet device has a recess on its left side and a recess on its right side;

the first handle is connected to the left side of the base of the ratchet device by inserting the extension of the first end of the first handle into the recess on the left side of the base of the ratchet device;

the second handle is connected to the right side of the base of the ratchet device by inserting the extension of the first end of the second handle into the recess on the right side of the base of the ratchet device; and wherein the extension of the first handle has a springy device connected to it so that the extension of the first handle and the springy device for the extension of the first handle can be inserted into the recess on the left side of the base of the ratchet device and the first handle will be held to the left side of the base of the ratchet device.

5. The apparatus of claim 4 wherein the extension of the second handle has a springy device connected to it so that the extension of the second handle and the springy device for the extension of the second handle can be inserted into the recess of the right side of the base of the ratchet device and the second handle will be held to the right side of the base of the ratchet device.

6. The apparatus of claim 5 wherein the extension of the first handle is substantially boxlike in shape and the springy device for the first handle is connected to the side of the boxlike shape and can be pushed inwards into the boxlike shape when pressure is exerted on the springy device the extension of the second handle is substantially boxlike in shape and the springy device for the second handle is connected to the side of the boxlike shape and can be pushed inwards into the boxlike shape when pressure is exerted on the springy device.

7. The apparatus of claim 6 wherein the springy device of the first handle has a rounded tip which when pressure is not applied protrudes outward from the extension of the first handle; and the springy device of the second handle has a rounded tip which when pressure is not applied protrudes outward from the extension of the second handle.

8. An apparatus comprising:

a first handle;

a second handle;

a ratchet device having an attachment device and a base;

wherein the attachment device is rotatable with respect to the base either clockwise or counterclockwise but not both, wherein the base of the ratchet device has a left side and a right side, and the first handle is connected to the base of the ratchet device at the left side of the base; and the second handle is connected to the base of the ratchet device at the right side of the base;

wherein the first handle is an elongated bar having a first end and a second end and the first handle is connected to the left side of the base of the ratchet device at the first end of the first handle; and the second handle is an elongated bar having a first end and a second end and the second handle is connected to the right side of the base of the ratchet device at the first end of the second handle;

wherein the first end of the first handle has an extension;

the first end of the second handle has an extension;

the base of the ratchet device has a recess on its left side and a recess on its right side;

the first handle is connected to the left side of the base of the ratchet device by inserting the extension of the first end of the first handle into the recess on the left side of the base of the ratchet device;

the second handle is connected to the right side of the base of the ratchet device by inserting the extension of the first end of the second handle into the recess on the right side of the base of the ratchet device; and the second handle can be disconnected from the base of the ratchet device;

the first handle has a recess at its second end;

the second handle can be connected to the first handle by inserting the extension of the first end of the second handle into the recess at the second end of the first handle.

9. The apparatus of claim 8 wherein the extension of the first handle has threads on it and the recess on the left side of the base of the ratchet device has internal threads on its inner surface so that the first handle can be screwed into the left side of the base of the ratchet device.

10. The apparatus of claim 9 wherein the extension of the second handle has threads on it and the recess at the second end of the first handle has internal threads on its inner surface so that the second handle can be screwed into the first handle.

11. The apparatus of claim 8 wherein the extension of the first handle has a springy device connected to it so that the extension of the first handle can be inserted into the recess on the left side of the base of the ratchet device and the first handle will be held to the left side of the base of the ratchet device.

12. The apparatus of claim 11 wherein the extension of the second handle has a springy device connected to it so that the extension of the second handle can be inserted into the recess at the second end of the first handle and the second handle will be held to the first handle.

13. The apparatus of claim 11 wherein the extension of the first handle is substantially boxlike in shape and the springy device for the first handle is connected to the side of the boxlike shape and can be pushed inwards into the boxlike shape when pressure is exerted on the springy device the extension of the second handle is substantially boxlike in shape and the springy device for the second handle is connected to the side of the boxlike shape and can be pushed inwards into the boxlike shape when pressure is exerted on the springy device.

14. The apparatus of claim 13 wherein the springy device of the first handle has a rounded tip which when pressure is not applied protrudes outward from the extension of the first handle; and the springy device of the second handle has a rounded tip which when pressure is not applied protrudes outward from the extension of the second handle.

* * * * *